US005889544A

United States Patent [19]

Mey et al.

[11] Patent Number: 5,889,544

[45] **Date of Patent: *Mar. 30, 1999**

[54] ELECTROGRAPHIC PRINTER WITH MULTIPLE TRANSFER ELECTRODES

[75] Inventors: William Mey, Rochester; Thomas N. Tombs, Brockport; Thomas M. Stephany, Churchville; William J. Grande, Pittsford, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 843,688

[22] Filed: Apr. 10, 1997

[51] Int. Cl.[6] ..... G03G 13/083

[52] U.S. Cl. ..... 347/112; 347/115; 101/489; 101/DIG. 37; 358/300; 399/270; 399/310; 399/314

[58] Field of Search ..... 347/3, 112, 115, 347/117; 101/489, DIG. 37; 358/300; 399/270, 310, 314

[56] References Cited

U.S. PATENT DOCUMENTS 4,764,445 8/1988 Miskinis et al. .
4,875,060 10/1989 Masuda et al. .
5,255,018 10/1993 Matoba ..... 347/55
5,682,586 10/1997 Stephany et al. ..... 347/55 X
5,701,552 12/1997 Stephany et al. ..... 399/53

FOREIGN PATENT DOCUMENTS

Hei 4(1992)-141459 5/1992 Japan .

OTHER PUBLICATIONS

A. R. Kotz, "Magnetic Stylus Recording", *Journal of Applied Photographic Engineering* 7:44–49 (1981).

*Primary Examiner*—Richard Moses
*Attorney, Agent, or Firm*—Thomas H. Close

[57] ABSTRACT

Electrographic printing apparatus for forming a toner image on a recording medium, includes: a magnetic brush having a rotatable magnetic core and a stationary outer shell; a developer supply for supplying a magnetic developer powder including toner to the magnetic brush. A print head on the outer shell forms a plurality of parallel lines of developer. Toner is selectively transferred from a plurality of electrodes within each line to a receiver. A receiver electrode is arranged in spaced relation to the print head to define a recording region through which the receiver can be moved.

19 Claims, 3 Drawing Sheets

ELECTROGRAPHIC PRINTER WITH MULTIPLE TRANSFER ELECTRODES

CROSS REFERENCE TO RELATED APPLICATIONS

Reference is made to U.S. Ser. No. 08/294,294, filed Aug. 23, 1994, entitled "Electrographic Printing Process and Apparatus" by Williamn Mey et al., and to Ser. No. 08/620, 655, filed Mar. 22, 1996, entitled "Microchannel Print Head for Electrographic Printer" by William Grande, et al.

1. Field of the Invention

The invention relates generally to the field of printing, and in particular to electrographic printing methods and apparatus.

2. Background of the Invention

An electrographic printing process wherein a magnetically responsive electrically conductive toner material is deposited directly on a dielectric receiver as a result of electronic current flow from an array of magnetically permeable styli into toner chains formed at the tips of the styli is disclosed in an article entitled "Magnetic Stylus Recording" by A. R. Kotz, Journal of Applied Photographic Engineering 7:44–49 (1981).

The toner material described by Kotz is a single-component, magnetically responsive, electrically conductive toner powder, as distinguished from multiple-component carrier/toner mixtures also used in electrophotographic development systems. The magnetically permeable styli described by Kotz are a linear array of magnetically permeable wires potted in a suitable material and arranged such that the ends of the wires are perpendicular to the receiver surface. A major advantage of this system is that it operates in response to relatively low voltage control signals (of the order of 10 volts), thereby allowing direct operation from inexpensive integrated circuits.

One shortcoming of the printing process described by Kotz is that the resolution of the printing system is limited by cross talk between the styli in the print head. Another shortcoming is the lack of redundancy or backup electrodes in the event that one of the electrodes fails, thereby rendering the print head useless. It would be desirable to provide multiple gray level printing using such a print head. It would also be desirable to make a full color printer using an electrographic printing technique.

SUMMARY OF THE INVENTION

The present invention is directed to overcoming one or more of the problems set forth above. According to the present invention, an electrographic printing apparatus for forming a toner image on a recording medium, includes a magnetic brush having a rotatable magnetic core and a stationary outer shell and a developer supply for supplying a magnetic developer powder including toner to the magnetic brush. A print head is located on the outer shell of the magnetic brush and includes means, such as microchannels or magnetic strips, for forming a plurality of parallel lines of developer. Toner is selectively transferred from multiple transfer electrodes within each line of developer to a receiver. A receiver electrode is arranged in spaced relation to the print head to define a recording region through which the receiver can be moved. By providing for multiple transfer electrodes for each line of developer, reduction in cross talk, reduced manufacturing cost, and improved performance is achieved. In a preferred embodiment of the invention, the transfer electrodes in adjacent lines are staggered in a direction perpendicular to the line, thereby increasing the spatial separation between transfer electrodes and reducing electrical cross talk between adjacent transfer electrodes.

According to another aspect of the invention, the multiple transfer electrodes are used to effect gray level printing, either by selectively effecting different numbers of toner transfers per image pixel, or by transferring different amounts of toner from different transfer electrodes per image pixel.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has a number of advantages in using the concepts described herein, and they are as follows:

1. Adds redundancy by having additional transfer electrodes per image pixel.
2. Enables increased density by using multiple transfer electrodes per image pixel.
3. Enables gray level printing by selectively transferring different amounts of toner from different transfer electrodes.
4. Facilitates improved throughput by simultaneously printing more than one line of image pixels at a time.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
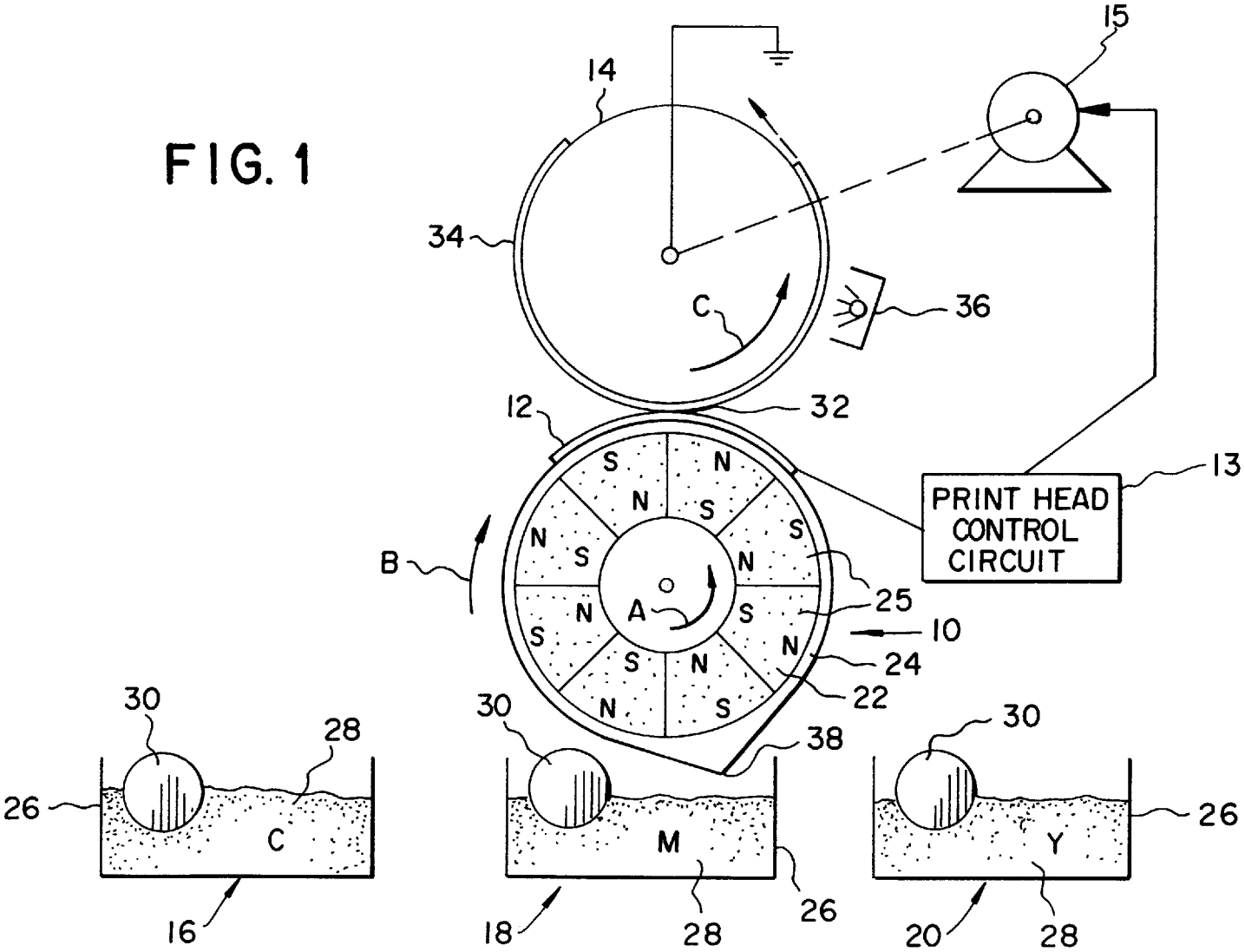
FIG. 1 is a schematic diagram of an electrographic color printer according to the present invention.

Referring to FIG. 1, an electrographic color printer according to the present invention is shown. The printer includes a magnetic brush generally designated 10, a print head 12 driven by a print head control circuit 13, a receiver electrode 14 driven by a stepper motor 15, and three developer supplies 16, 18 and 20 for supplying cyan, magenta and yellow developer powder to the magnetic brush 10, respectively. In a printer adapted to print text as well as color images, a fourth developer supply (not shown) for supplying black developer powder to the magnetic brush may be provided. The stepper motor 15 is powered by pulse control circuit 13 to synchronize the printing of the different colored developers.

The magnetic brush 10 includes a rotatable magnetic core 22 and stationary outer cylindrical shell 24 characterized by low magnetic permeability and high electrical conductivity. The rotatable magnetic core includes a plurality of permanent magnetic sectors 25 arranged about and extending parallel to the cylindrical surface of the shell 24 to define a cylindrical peripheral surface having alternating North and South magnetic poles. In operation, the magnetic core 22 rotates in a counter clockwise direction as indicated by arrow A to transport developer around the circumference of shell 24 in a clockwise direction as indicated by arrow B.

Each of the three developer supplies 16, 18, and 20 is constructed in a similar manner and is moveable from a position immediately adjacent the magnetic brush 10 as illustrated by supply 18, to a position away from the magnetic brush as illustrated by supplies 16 and 20 in FIG. 1. Each developer supply includes a sump 26 for containing a supply of magnetic developer 28, for example, a two component developer of the type having an electrically conductive, magnetically attractive carrier and a colored toner. A suitable developer is described in U.S. Pat. No. 4,764,445 issued Aug. 16, 1993 to Miskinis et al. The performance of the system can be optimized by employing the carrier having a balanced conductivity low enough to triboelectrically charge the toner particle, but high enough to conduct electricity. A rotatable magnetic feed roller 30 is actuable for delivering developer 28 from the sump 26 to the magnetic brush 10 in a known manner. Alternatively, the present invention can be employed with a printer using single component magnetic developers. In the single component magnetic developers, the carrier and toner components of the developer are combined into a single particle that is transferred to the receiver.

The print head 12 is mounted on the outer surface of shell 24 opposite receiver electrode 14 to define a recording region 32. A receiver 34, such as dielectric coated or plain paper, is wrapped around the receiver electrode 14 and moved through the recording region 32 in the direction of arrow C with one surface in contact with receiver electrode 14. Alternatively, the direction of the receiver and the flow of developer may be in opposite directions. A fusing station 36 may be provided as is known in the art to fuse the toner image to the receiver 34. The fusing station 36 may comprise for example a radiant heat source or a hot roller.

In operation, a first developer supply, say the magenta supply 18 is moved into position adjacent the magnetic brush 10. The magnetic feed roller 30 is actuated to supply developer 28 to the magnetic brush 10. The developer 28 is transported around the periphery of the magnetic brush 10 to the recording region 32, where pulses are selectively applied to an array of transfer electrodes in print head 12 by print head control circuit 13 to transfer toner from the developer 28 to the receiver 34 in an imagewise manner as the receiver is moved by stepper motor 15 through the recording region 32. After the first color component of the image (e.g. magenta) is formed on the receiver 34, the remaining developer is removed from the magnetic brush 10.

Means are provided on the shell 24 of the magnetic brush 10 such as a lip 38 which extends a distance from the magnetic core 22 so that as the developer is transported around the periphery of the shell 24, it is moved away from the influence of the magnetic core 22 to the point where it falls back into the sump 26. Alternatively, another magnetic brush and sump (not shown) having only magnetic carrier (no toner) may be provided for cleaning. The magnetic carrier is transported around the magnetic brush to scavenge residual toner from the magnetic brush 10 and print head 12. Such an arrangement is called a magnetic brush cleaning station in the prior art. Alternatively, a separate magnetic brush 10 and print head 12 may be provided for each color of developer, thereby avoiding the need to clean the magnetic brush and print head after each color.

Next, the developer supply 18 is moved away from the magnetic brush 10 and the next developer supply (e.g. the yellow developer supply 20) is moved into position to replace it. The receiver 34 is repositioned by print head control circuit 13 and stepper motor 15 to record the yellow component of the image and insure registration between the various color components and the recording process described above is repeated. Finally, the cyan component of the full color image is recorded in a similar fashion. After the three image components are recorded, the full color image is fused to the receiver 34 at fusing station 36. Alternatively, each color developer may be fused or tacked (i.e. partially fused to better adhere the toner to the receiver prior to subsequent final fusing) after deposition and prior to the deposition of the subsequent color.

A potential limitation with the printing configuration shown in FIG. 1 is that for high resolution printing (i.e. greater than 300 dots/inch) electrical cross talk between lines of developer may occur. An additional limitation is a lack of redundancy or backup transfer electrodes when a single transfer electrode is used for each line of developer. Still another limitation is a lack of potentially overlapping transfer electrodes within a line of developer for use in gray level printing. These problems are solved according to the present invention by providing at least two transfer electrodes per line of developer and staggering the transfer electrodes between adjacent lines of developer.

Figure 2:
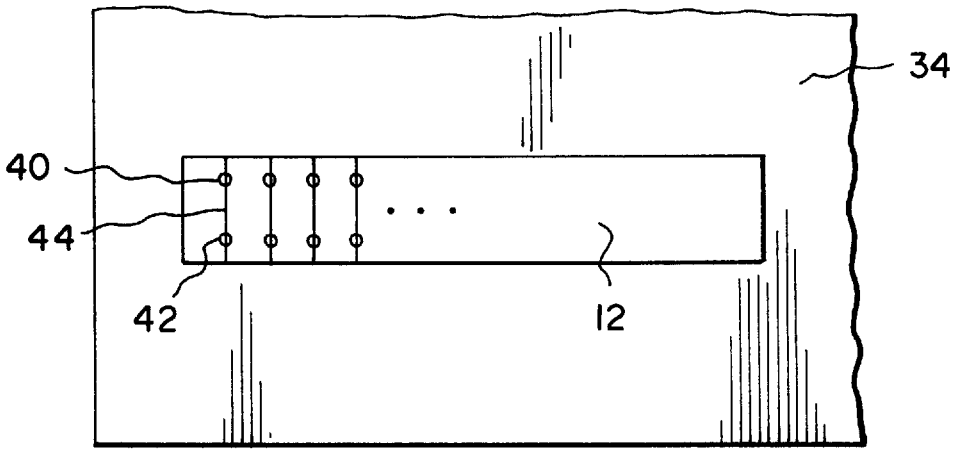
FIG. 2 is a schematic top view of the print head of the present invention, showing multiple transfer electrodes for each line of developer.

Transfer electrode redundancy and additional gray level printing capability is provided as shown in FIG. 2. At least two transfer electrodes 40 and 42 are provided for each line of developer 44. The multiple transfer electrodes per line of developer may be used to provide redundancy in the print head so that, in the event that one of the transfer locations fails, another may be used as a backup. Alternatively, the multiple transfer electrodes in each line of developer may be used for generating multiple gray levels per dot. The multiple gray levels may be obtained either by transferring the same or different amounts of toner from each transfer electrode. Different amounts of toner can be transferred by applying different voltages to the transfer electrodes. For example, the voltage applied to one electrode may be adjusted to transfer twice the amount of toner than the other electrode, in a two electrode per line configuration. Four levels of gray per image pixel may be achieved by applying no toner, toner from the lesser transfer electrode, toner from the greater transfer electrode, or toner from both the transfer electrodes.

Figure 3:
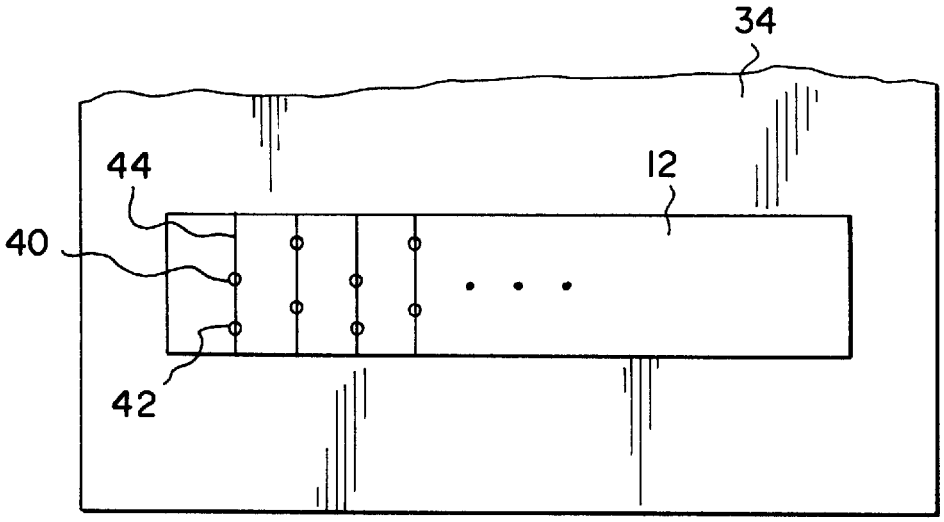
FIG. 3 is a schematic top view of the print head of the present invention, showing multiple staggered transfer electrodes for each line of developer.

Referring to FIG. 3, the transfer electrodes 40 and 42 in each line of developer 44 may be staggered with respect to the electrodes in adjacent lines. By staggering the electrodes, the distance between adjacent electrodes is increased, thereby reducing or eliminating electrical cross talk between adjacent electrodes.

Figure 4:
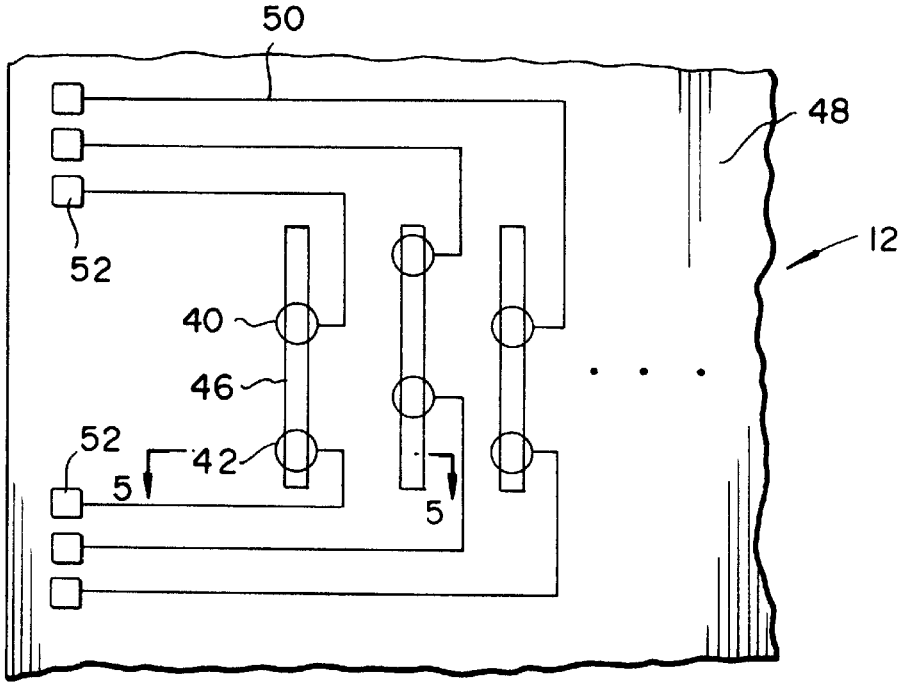
FIG. 4 is a partial top view of the print head of the present invention employing magnetic strips to form lines of developer, showing multiple staggered transfer electrodes on each of the magnetic strips.
Figure 5:
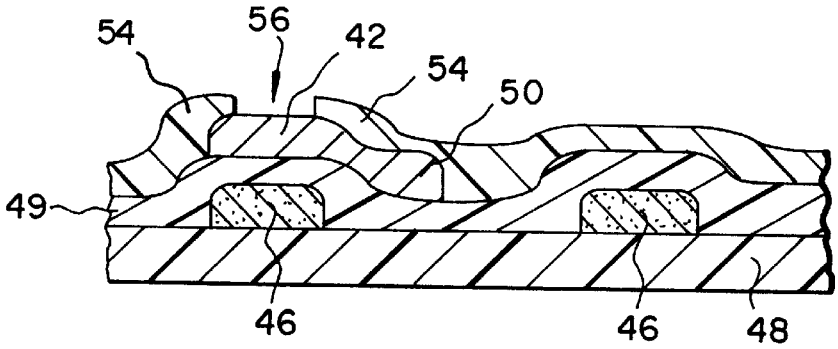
FIG. 5 is a cross sectional view taken along lines 5—5 in FIG. 4.

Referring to FIGS. 4 and 5, a print head having multiple staggered electrodes according to the present invention is shown. The print head 12 includes a plurality of magnetic strips 46, such as permalloy, on an insulating substrate 48, such as a flex circuit material. This approach to forming lines of developer is the subject of copending U.S. Ser. No. 08/294,294, filed Aug. 23, 1994, entitled "Electrographic Printing Process and Apparatus" by William Mey et al. The magnetic strips 46 may be electrically nonconducting, or they are electrically insulated by a layer of insulation 49. Transfer electrodes 40 and 42 are located over the strips 46. The transfer electrodes 40 and 42 are nonmagnetic and are connected to nonmagnetic conductors, such as copper circuit board traces 50 and thence to contact pads 52. Circuit traces 50 are covered by an electrically insulating layer 54, such as a photopolymer. The insulating layer 54 is provided with holes 56 located over the transfer electrodes 40 and 42, for example by photofabrication. As magnetic developer 28 is moved over the print head 12 by magnetic brush 10, the magnetic strips 46 cause the developer to form separate lines over the magnetic strips. When a sufficient voltage, on the order of 100 volts, is applied to the magnetic strips by the print head control circuit 13, toner is transferred from the lines of developer on the print head 12 to the receiver 34.

Figure 6:
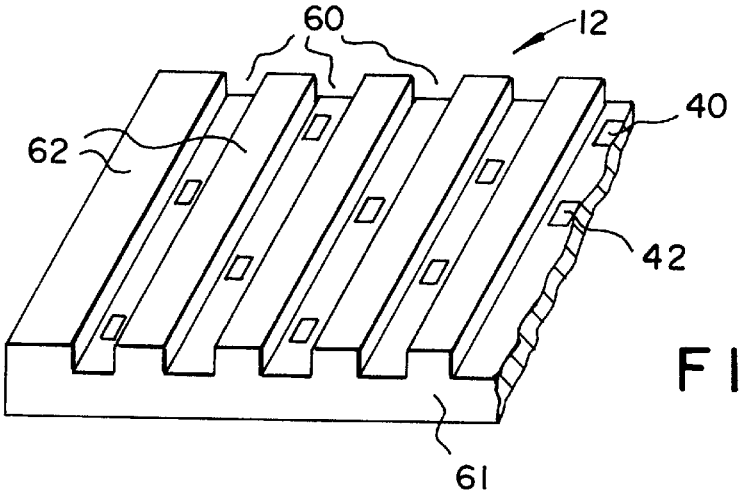
FIG. 6 is a partial top view of the print head of the present invention employing microchannels to form lines of developer, showing multiple staggered transfer electrodes in each of the microchannels.

Alternatively, as shown in FIG. 6, the print head 12 includes a plurality of parallel microchannels 60 on a substrate 61 separated by channel walls 62 that function to form a plurality of parallel lines of developer in the microchannels 60. This approach to forming lines of developer is the subject of U.S. Ser. No. 08/620,655, filed Mar. 22, 1996, entitled "Microchannel Print Head For Electrographic Printer" by W. Grande, et al.

The microchannels 60 are at least wider than the largest developer particles (e.g. 8 to 50 microns) and channel walls 62 are preferably in the range of 10 to 200 microns wide. The width of the channels plus the width of the walls determines the distance between the channels, thus, the spacing between channels will be between 18 and 250 microns, preferably 40 to 200 microns. The print head width is determined by the number and spacing of the transfer electrodes per line of developer. For example, for a print head having six transfer locations spaced apart by 244 microns within the line, the print head has a dimension of about 1.5 mm in the direction of developer travel and as wide as a full page (e.g. 21.6 cm). Alternatively, a print head shorter than a page width (e.g. 2.5 cm) may be used and scanned across the page to provide full page printing. Preferably, the number of transfer locations in a line is in the range of 4 to 16.

A pair of electrically conducting transfer electrodes 40 and 42 is located in each channel for transferring toner from the channel to the receiver 34. In one embodiment the substrate 61 is silicon and the microchannels 60 are formed in the surface of the silicon using known micromachining techniques. In this case the transfer electrodes 40 and 42 are formed using conventional vacuum deposition and shadow masking manufacturing techniques. Additionally, a portion of the control circuitry, such as current drivers for applying printing voltage pulses to the electrodes 40 and 42, may be integrated into the substrate 61. Alternatively, the transfer electrodes and control circuitry may be integrated into a silicon substrate and the channel walls formed on the substrate using a photopolymer and photolithography. According to a further alternative, the microchannel print head is fabricated on a flexible substrate, such as flex circuit material, and the microchannels are formed by a photolithographic process using photopolymer. To further restrain the developer to the microchannels, strips of magnetically permeable material similar to those shown in FIGS. 4 and 5 may be located in the bottoms of the microchannels.

If the print head is flat and the receiver is mounted on a drum as shown in FIG. 1, the distance between the transfer electrodes and the receiver may vary with electrode location. As a result, the electric field, and hence toner transfer efficiency could be different for different transfer electrodes within a line of developer. Transfer electrodes closer to the receiver may produce a more dense pixel than those further away from the receiver. This effect can be avoided by flattening the receiver in the region of toner transfer, for example, by employing a flat surface, such as a platen or a flexible belt. Alternatively, different voltages may be applied to the transfer electrodes to keep a constant electric field between the receiver and electrode.

The invention has been described with reference to a preferred embodiment. However, it will be appreciated that variations and modifications can be effected by a person of ordinary skill in the art without departing from the scope of the invention.

PARTS LIST

10 magnetic brush
12 print head
13 print head control circuit
14 receiver electrode
15 stepper motor
16 developer supply
18 developer supply
20 developer supply
22 rotatable magnetic core
24 stationary outer shell
25 permanent magnetic sectors
26 developer sump
28 magnetic developer
30 rotatable magnetic feed roller
32 recording region
34 receiver
36 fusing station
38 lip
40 transfer electrode
42 transfer electrode
44 line of developer
46 magnetic strip
48 insulating substrate
49 insulation layer
50 circuit trace
52 contact pad
54 electrically insulating layer
56 hole
60 microchannel
61 substrate
62 channel walls

What is claimed is:

1. Electrographic printing apparatus for forming a toner image on a recording medium, comprising:

a) a magnetic brush having a rotatable magnetic core and a stationary outer shell;

b) a developer supply for supplying a magnetic developer powder including toner to the magnetic brush;

c) a print head on the outer shell, the print head including means for simultaneously forming a plurality of parallel lines of developer, and a plurality of transfer electrodes for selectively transferring toner from a plurality of transfer locations within each line to a receiver; and d) a receiver electrode arranged in spaced relation to the transfer electrodes to define a recording region through which the receiver can be moved.

2. The electrographic printing apparatus claimed in claim 1, wherein the means for forming a plurality of parallel lines of developer comprise a plurality of strips of magnetically permeable material.

3. The electrographic printing apparatus claimed in claim 1, wherein the means for forming a plurality of parallel lines of developer comprise a plurality of microchannels.

4. The electrographic printing apparatus claimed in claim 3, wherein the print head comprises a nonflexible substrate having microchannel walls formed from photoimageable polymer.

5. The electrographic printing apparatus claimed in claim 1, wherein the developer is a dual-component developer.

6. The electrographic printing apparatus claimed in claim 3, further comprising strips of magnetically permeable material located in the microchannels.

7. The electrographic printing apparatus claimed in claim 1, wherein the transfer electrodes are staggered with respect to each other in a direction perpendicular to the lines of developer.

8. The electrographic printing apparatus claimed in claim 1, wherein the transfer electrodes are arranged in non-staggered lines perpendicular to the lines of developer.

9. The electrographic printing apparatus claimed in claim 1, wherein the number of transfer electrodes in each line is between 2 and 16.

10. The electrographic printing apparatus claimed in claim 1, wherein the transfer electrodes are gold.

11. The electrographic printing apparatus claimed in claim 1, wherein the print head comprises a silicon substrate and further comprises a circuit for selectively applying voltage to the transfer electrodes, the circuit being integrated into the silicon substrate.

12. An electrographic printing method, comprising the steps of:

a) supplying a magnetic developer to a print head;

b) confining the developer at the print head to simultaneously form a plurality of parallel lines of developer; and c) selectively transferring developer in an imagewise manner by a plurality of transfer electrodes from a plurality of transfer locations within each of the lines to the receiver.

13. The electrographic printing method claimed in claim 12, wherein the printhead is formed on a silicon substrate by integrated circuit manufacturing techniques.

14. The electrographic printing method claimed in claim 12, wherein the developer is a dual-component developer.

15. The electrographic printing method claimed in claim 12, wherein the lines are formed by confining the developer with an array of magnetically permeable strips.

16. The electrographic printing method claimed in claim 12, wherein the lines are formed by confining the developer with an array of microchannels.

17. The electrographic printing method claimed in claim 16, wherein the lines are further formed by magnetically permeable strips located in the microchannels.

18. A print head for an electrographic printer of the type having a magnetic brush for transporting magnetic developer to a recording region and a receiver for receiving an imagewise pattern of a component of the developer at the recording region, the print head comprising:

a) a substrate defining a plurality of parallel microchannels for confining the developer to flow in the microchannels; and b) a plurality of selectively addressable transfer electrodes located at the bottom of each microchannel for selectively transferring the component of the developer to the receiver from a plurality of transfer locations in each of the microchannels.

19. The electrographic printing apparatus claimed in claim 3, wherein the print head comprises a silicon substrate and the microchannels are formed in the surface of the silicon.

* * * * *